United States Patent [19]

Fatigati

[11] Patent Number: 4,998,418

[45] Date of Patent: Mar. 12, 1991

[54] FEED FINGER FOR KNITTING MACHINES

[75] Inventor: Charles Fatigati, East Meadow, N.Y.

[73] Assignee: Knittex Fashions, Inc., Ridgewood, N.Y.

[21] Appl. No.: 483,325

[22] Filed: Feb. 20, 1990

Related U.S. Application Data

[63] Continuation of Ser. No. 229,701, Aug. 8, 1988, abandoned.

[51] Int. Cl.[5] ..... D04B 9/34; D04B 15/54; D04B 9/10

[52] U.S. Cl. ..... 66/14; 66/136

[58] Field of Search ..... 66/125 R, 14, 136, 137

[56] References Cited

U.S. PATENT DOCUMENTS

| | | | |
|---|---|---|---|
| 1,584,099 | 5/1926 | Kane | 66/136 |
| 1,933,408 | 10/1933 | Bentley et al. | 66/136 |
| 2,464,126 | 3/1949 | Fregeolle | 66/14 |

FOREIGN PATENT DOCUMENTS

| | | | |
|---|---|---|---|
| 301350 | 11/1928 | United Kingdom | 66/14 |
| 1381645 | 1/1975 | United Kingdom | 66/137 |

*Primary Examiner*—Wm. Carter Reynolds
*Attorney, Agent, or Firm*—Bauer & Schaffer

[57] ABSTRACT

A yarn feed finter for use on circular Links and Links knitting apparatus for the manufacture of plaited fabric. The finger has a generally elongated, rectangular-shaped flat body having a pair of eyelets located thereon in a side-by-side disposition and which are slightly offset from each other. The finger is adapted for pivotal movement into and out of active position with the needles of the apparatus and to direct through the eyelets simultaneously in parallel with each other and at different angles of approach to the needles to feed at least two yarns to the needles to produce a plaited fabric in which one yarn is visible on one side of the fabric, and another yarn is visible on the other side.

2 Claims, 1 Drawing Sheet

FEED FINGER FOR KNITTING MACHINES

This is a continuation of Ser. No.: 229,701 filed: Aug. 8, 1988, now abandoned.

BACKGROUND OF THE INVENTION

This invention relates to a yarn feed for knitting machines, and more particularly, to an improved feed finger for use on circular Links and Links knitting apparatus for the manufacture therewith of plaited knit fabrics.

A wide variety of knitting machines are known, including various circular Links and Links knitting apparatus. Such machines are used, amongst other purposes, in making striped or plaited fabrics in which more than one yarn is fed to single selected needles so that when the knit is completed, one yarn lies above the other, thereby providing the striping. It is critical in such operations to be able to feed the yarns precisely and in a predetermined manner to obtain uniform stitching, rather than random knitting. A wide variety of yarn feeds for such knitting operations have been developed, including a variety of finger constructions for feeding one or more yarns to the knitting needles. For example, feed or guide fingers which have two eyelets or openings for feeding yarns to be knitted to form plaited fabrics are disclosed in U.S. Pat. Nos. 348,503; 851,042; 1,129,261; 1,204,445; and 1,584,099.

Yarn feed fingers are also disclosed in U.S. Pat. Nos. 1,846,892; 3,263,454; 2,780,422; and 4,589,266. In addition, plaiting feed mechanisms are disclosed in U.S. Pat. Nos. 3,930,386 and 2,796,752.

However, these known devices usually are disadvantageous in that when using them uniform feeding is, in fact, not accomplished. Therefore, rather than being used in making plaited knit outer fabrics, they are used generally only in making selvedges wherein uniformity is not critical.

To overcome the foregoing disadvantages as well as others, the known machines have been provided with a carrier and plaiting plate positioned remote from the normal feed fingers and needles which operate to supply the second or plaiting yarn directly to the needles. The plaiting plates were not capable of making the selvedges unless one or more sections of the knitting maching machines were taken out of action. This necessitates shutting down one portion of a circular knitting apparatus while they perform their function on another portion. Thus, the machines were not able to alternatively provide plaiting or selvedging without considerable downtime cost.

There exists, therefore, a need for yarn feed fingers which do not exhibit such disadvantages, especially in thhe manufacture of plaited knit fabrics. The present invention fulfills such need.

BRIEF STATEMENT OF THE INVENTION

In accordance with the invention there is provided an improved feed finger, for use on circular Links and Links knitting machines provided with a plurality of needles, to manufacture plaited fabric. The finger comprises a body portion having a pair of eyelets located thereon in a side-by-side parallel disposition and slightly offset axially from each other. The finger is adapted for pivotal movement into and out of active knitting position with respect to the needles and to direct a pair of yarns through the eyelets, simultaneously and in parallel with each other and at such defined angles of approach, whereby the yarns engage the needles at precisely the desired point to produce a uniform plaited knit fabric in which one yarn is visible on one side of the fabric, and the other yarn is visible on the other side of the fabric.

THE DRAWINGS

In order to understand more fully the improved feed finger of this invention, reference is directed to the accompanying drawings which are to be taken in conjunction with the following description of the invention and in which.

DESCRIPTION OF THE PREFERRED EMBODIMENT

Figure 1:
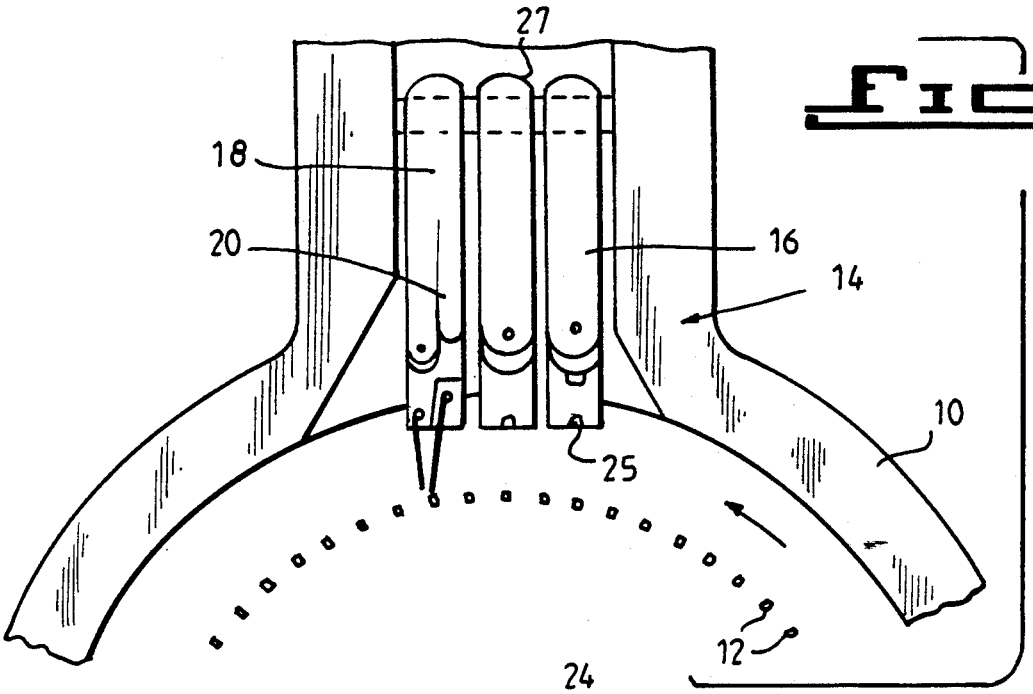
FIG. 1 is a fragmentary view of a typical conventional knitting machine showing the yarn feed finger of the present invention in combination with the conventional single yarn feed finger.

Schematically illustrated in FIG. 1 is a circular knitting machine having a ring 10 and a plurality of needles 12 arranged in a circle within the cylinder. The cylinder 10 is divided into a plurality of sectors (only one being shown), each having an associated number of needles, and a yarn feed, generally indicated by the numeral 14. Each feed 14 is provided with a plurality of yarn feed fingers 16 through each of which a yarn 20 is fed to a corresponding needle 12 as the needles move within the sector. For convenience, FIG. 1 shows the feed finger of the present invention (finger 18) with conventional feed fingers (fingers 16), it being understood, of course, that the present feed finger 18 is not part of the prior art.

In general, such Links and Links knitting machines are double cylinder apparatus having top and bottom cylinders, with knitting needles active both up and down. The needles have hooks at both ends for receiving the yarn, and the feed fingers have to feed yarns to adjacent needles wherein one needle goes up, and the other needle goes down. Exemplary of any one of the circular knitting machines adaptable for plaiting are those made by Wildman Jacquard Co., Norristown, Pa., under the designation of "Links and Links Knitting Machines" (Models LH 1–LH 6 or later) which may be referred to for specific details as if more fully set forth herein. These machines employ the conventional one yarn feed finger 16.

Figure 2:
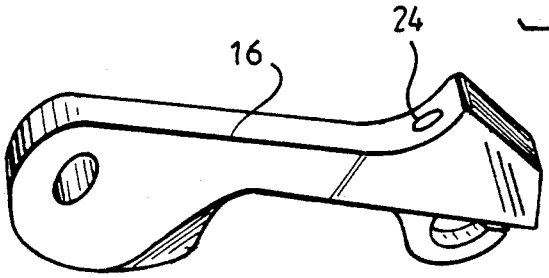
Fig. 2 PRIOR ART
FIG. 2 is an elevational view of the prior art yarn feed finger.

As seen in FIG. 2, the prior art form of a yarn feed finger 16 has a single eyelet 24 through which yarn 20 is fed to the needles on a Links and Links knitting apparatus. Finger 16, as previously described, is pivotally fixed to the frame of the machine to move in a vertical plane radially to the needles. Since each finger is generally provided with a single eye, such a finger cannot be used at high speeds to make selvedges or striped knit fabric. In order to make a selvedge or border on each fabric, it is necessary to take at least some sections of the apparatus out of action, thus reducing the speed, efficiency, and other normal advantages of the apparatus. Furthermore, since the fingers in such Links and Links machines are used to feed only the non-knitting yarns for the selvedge and border, as previously mentioned, and can not be used for plaiting, it is not possible to use two needles for plaiting because the offset yarn is subject to breakage.

The inability to feed two yarns to a single needle, in either the up or down movement, is obvious from FIG. 1, since in order to do this, yarn from one finger would have to cross over the yarn from the other finger or be fed at a very different angle to the needle which in the interim, moved in a wide arc away from the first needle feed. Therefore, when apparatus is equipped with multiple yarns to be used for plaiting, that section of the apparatus to be so employed has to be normally shut down and placed out of action, thus limiting production. Still further, utilization of a plaiting plate must be installed adjacent the needle bed to effect plaiting.

Figure 3:
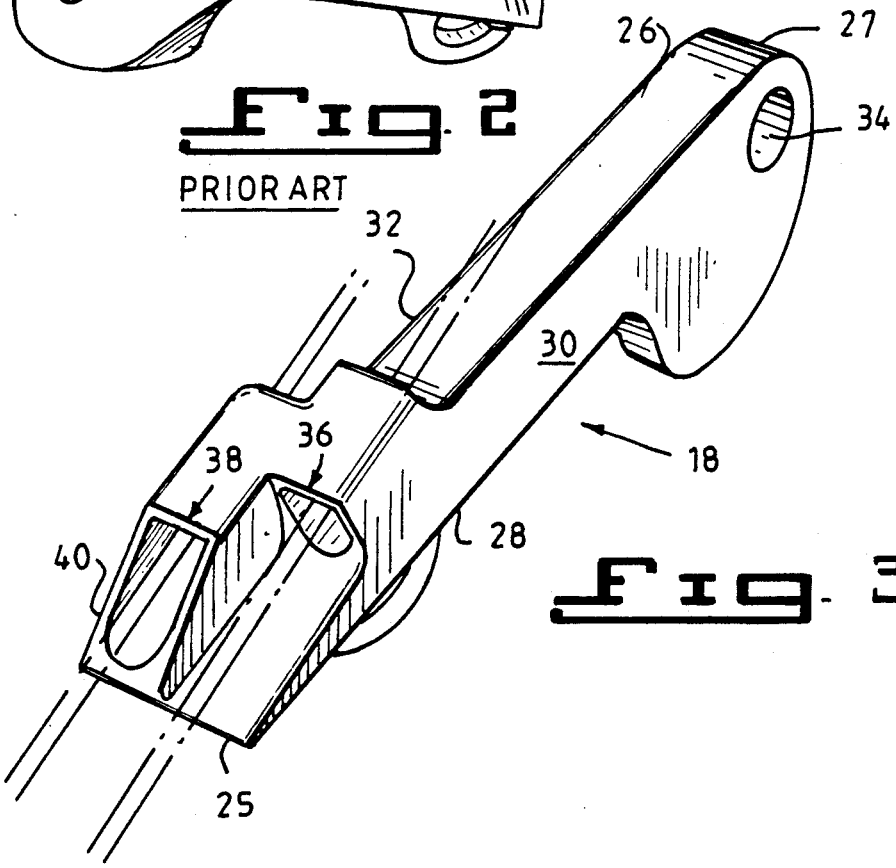
FIG. 3 is an enlarged elevational view of the improved feed finger of this invention shown in FIG. 1.

On the other hand, the improved feed finger 18 of this invention, as shown in FIG. 3, can be used not only for simple plaiting but can also be used in combination with the needles to produce a variety of complex plaited knit patterns as well as providing a selvedge or border. Finger 18 has a shape generally compatible to that of the prior art finger, 16 in that generally elongated flat rectilinear body portion having a leading edge 25, an upper surface 26, a lower surface 28, and side surfaces 30 and 32 is provided. On the trailing edge 27 of the improved feed finger there is provided a through opening 34 for attaching the finger to standard pivoting means similarly to that of the conventional finger.

The improved feed finger 18 has a pair of eyelets 36 and 38 located on the upper surface 26 of the body portion of the finger. The eyelets, each having a bottom coplanar with the upper surface 26, are in a side-by-side parallel disposition, with the eyelet 36 slightly offset axially to the rear with respect to the eyelet 36. The entrance to eyelet 36 and its exit are similarly positioned behind the corresponding entrance and exit of the eyelet 38. The eyelets 36 and 38 are relatively close to each other in transverse direction so that the angles at which the yarn meets the needle and can be selected to accomplish plaiting without any reduction in the speed of knitting and without yarn breakage. The exit of eyelet 38, in fact, comprises the frontal face 40 of the feed finger 18. This face 40 is slanted forwardly from the upper surface 26 to the leading edge 25 for convenience of yarn movement and for convenience in installation, handling and visualation in the knitting machine. Because of the offset parallel disposition of the eyelets, two yarns may be fed through a single feed, finger 18 to a selected single needle 12 at the same level and in proper selected angle of approach, wherein one yarn overlays the other, thus producing a perfect plait. Because of the side-by-side disposition of the eyelets, the two yarns engage the rotationally moving needles precisely on point and uniformly on each selected hook.

Thus, plaiting can be accomplished by feeding a plurality of yarns of different selected colors through each eyelet simultaneously parallel to selected needles to produce a plaited knit fabric in which at least one yarn of one color is visible on one side of the fabric, and at least one yarn of another color is visible on the other side.

Should plaiting not be desired the improved feed finger 18 can be used with one yarn, and thus perform conventional knitting operations. The improved finger can also be put into and taken out of use in a conventional manner, without removal from the machine. Further, a plaiting plate is no longer necessary.

The feed finger 18 of this invention presents numerous advantages. It is of simple construction, can be made from readily available metals by simple manufacturing methods, and can be employed on standard, known Links and Links knitting apparatus as well as other knitting machines similar thereto. It permits more accuracy in feeding yarns to the needles and allows for variations in speed and tension of the yarns being fed. It permits maximum production since it is capable of use in making selvedges or borders as well in the main knit fabric body. Thus, it is not necessary to shut down or deactivate, section by section, the knitting apparatus. The finger of this invention as well does not interfere with other yarns fed. Numerous other advantages of the finger of this invention will be obvious to those skilled in the art.

It is to be understood that variations of this invention may be used without departing from the spirit and scope thereof. It is to be understood, therefore, that the invention is not to be limited to the described embodiments thereof except as defined in the appended claims.

What is claimed is:

1. An improved feed finger for use on circular Links and Links knitting apparatus provided with a plurality of needles and a plurality of feed fingers pivotal into and out of active knitting position with respect to said needles to manufacture plaited fabric, said improved feed finger comprising a generally elongated shaped flat body portion having means at its rear end for pivotal attachment to the frame of said knitting apparatus, a flat upper surface, a pair of elongated passages, each having a bottom coplanar with the upper surface of the finger, said passages extending along the flat body portion toward the forward end of said finger in a side-by-side parallel disposition and slightly offset from each other axially one to the rear of the other, said passages directing the respective yarns at substantially the same level and angle of approach to a single one of said needles to produce a plaited knit fabric in which at least one yarn is visible on one side of said fabric, and another yarn is visible on the other side of said fabric.

2. A Links and Links knitting machine for manufacturing plaited fabric, employing a plurality of feed fingers for feeding yarn to the needles, at least one of said fingers comprising a generally elongated shaped flat body portion including a flat upper surface, a pair of elongated tubular eyelets located on said upper surface in a side-by-side parallel disposition and slightly offset axially from each other, one eyelet terminating near the leading edge of said body portion, the other eyelet terminating axially to the rear of said first eyelet, said passages having a bottom coplanar with the flat surface, an opening located through the sides of said body portion near the trailing edge thereof for the pivotal attachment of said finger to the knitting apparatus for pivotal movement thereof into and out of active knitting position with respect to said needles and to direct yarn through each of said eyelets simultaneously at substantially the same level and angle of approach directly to a single one of said needles, so as to produce a plaited knit fabric in which at least one yarn is visible on one side of said fabric, and at least another yarn is visible on the other side of said fabric.

* * * * *